US005244332A

United States Patent [19]

Krein et al.

[11] Patent Number: 5,244,332

[45] Date of Patent: Sep. 14, 1993

[54] BULK LOADING METHOD AND APPARATUS

[75] Inventors: Reuben Krein; Jeff Smith, both of Fort Smith, Ark.

[73] Assignee: BJK Industries, Inc., Fort Smith, Ark.

[21] Appl. No.: 592,710

[22] Filed: Oct. 10, 1990

Related U.S. Application Data

[63] Continuation-in-part of Ser. No. 385,243, Jul. 25, 1989, Pat. No. 5,059,084, which is a continuation of Ser. No. 241,770, Sep. 7, 1988, Pat. No. 4,863,339, which is a continuation of Ser. No. 863,093, May 14, 1986, abandoned, which is a continuation-in-part of Ser. No. 733,962, Jun. 9, 1987, Pat. No. 4,671,733, which is a continuation-in-part of Ser. No. 502,696, May 14, 1985, Pat. No. 4,516,906.

[51] Int. Cl.[5] ..... B65D 88/12

[52] U.S. Cl. ..... 414/467; 414/412; 220/404; 220/1.5; 220/403; 296/39.1; 296/50

[58] Field of Search ..... 414/267, 786, 412, 373; 296/50, 39.1, 39.2, 39.3; 220/403, 404, 1.5, 601, 562, 611, 345, 375, 408; 222/105; 49/404

[56] References Cited

U.S. PATENT DOCUMENTS

| | | | |
|---|---|---|---|
| 2,088,072 | 7/1937 | Tobin | 296/50 X |
| 3,696,952 | 10/1972 | Bodenheimer | 414/412 X |
| 3,980,196 | 9/1976 | Paulyson et al. | 296/39.1 X |
| 4,124,136 | 11/1978 | Bjelland et al. | 296/39.1 X |
| 4,674,127 | 6/1987 | Yamada et al. | 220/404 X |
| 4,784,287 | 11/1988 | Yamada et al. | 220/1.5 X |
| 4,877,281 | 10/1989 | Altmann | 220/404 X |
| 4,911,317 | 3/1990 | Schloesser et al. | 220/1.5 |

FOREIGN PATENT DOCUMENTS

| | | | |
|---|---|---|---|
| 2218828 | 10/1973 | Fed. Rep. of Germany | 296/50 |
| 1122311 | 9/1956 | France | 296/50 |
| 6918892 | 6/1970 | Netherlands | 414/467 |
| 2226300 | 6/1990 | United Kingdom | 220/403 |

*Primary Examiner*—Frank E. Werner
*Attorney, Agent, or Firm*—Ross, Howison, Clapp & Korn

[57] ABSTRACT

A flexible bulkhead (36) is provided that includes a plurality of horizontal poles (38) disposed in channels (54) and (56) on opposite sides of a container (10). Webbing straps (50) and (52) are operable to space the poles (38) a predetermined distance apart when installed between hooks on either side of the container opening and at the upper and lower corners therein. When pulled taut, the webbing straps (50) and (52) maintain the material of the flexible bulkhead (36) in a taut configuration. Flaps (66) and (68) extend from the peripheral edges on the sides of the flexible bulkhead (36) and inward to the container (10). A liner (16) is then disposed in the container (10) and inflated with a vacuum system through a manifold (42) and a blower (22). The flaps (66) and (68) prevent deformation of the flexible material of the bulkhead (36) to minimize air from flowing under and around the flexible bulkhead (36).

9 Claims, 5 Drawing Sheets

FIG. 10
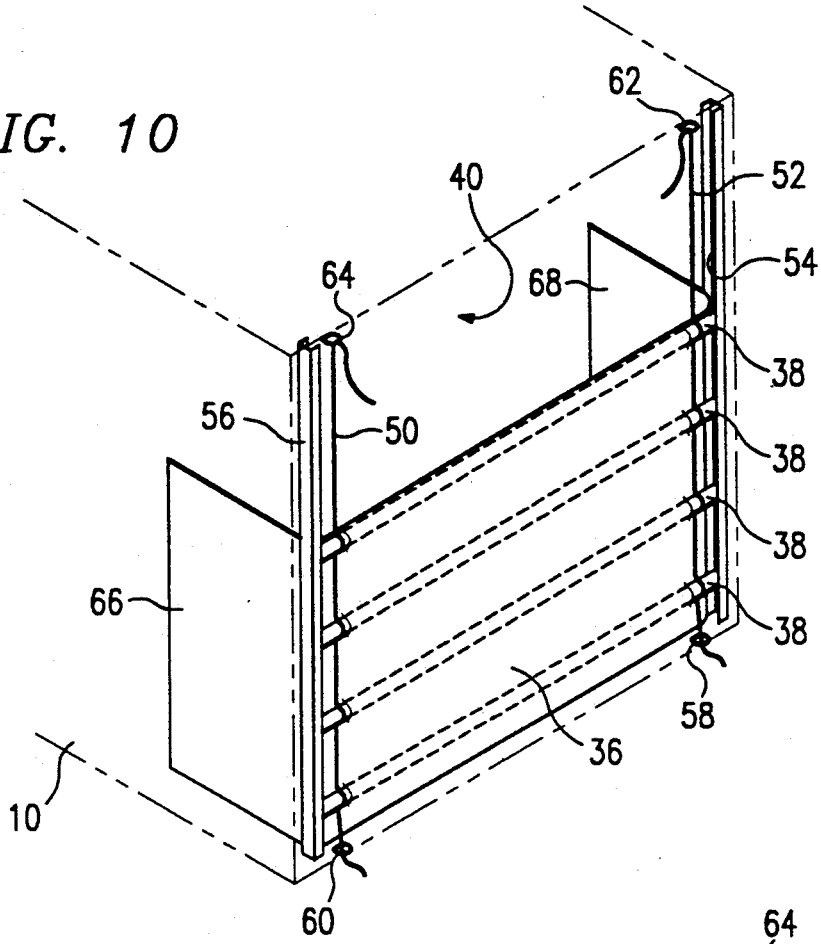
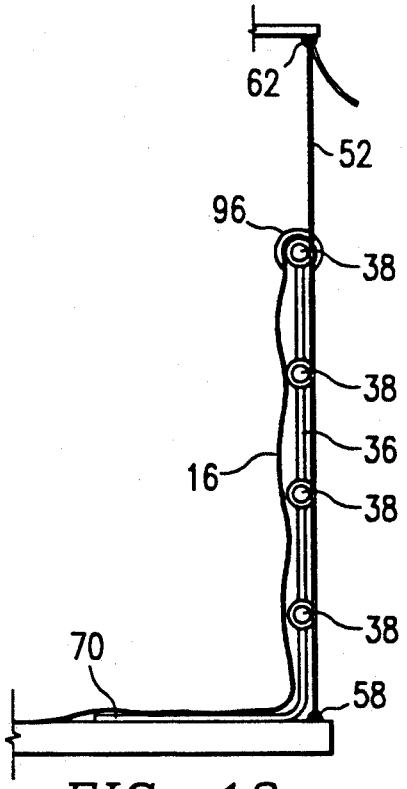
FIG. 13
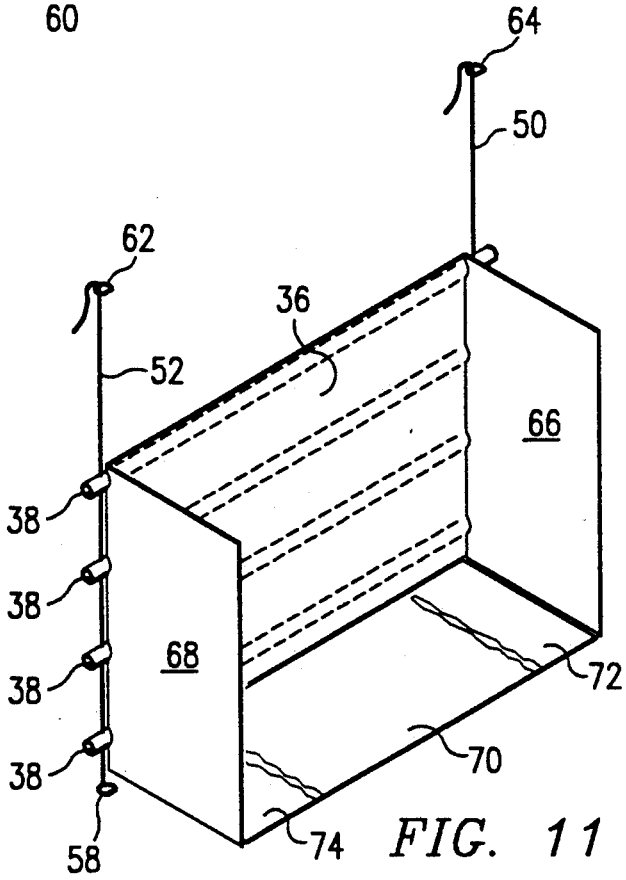
FIG. 11

BULK LOADING METHOD AND APPARATUS

CROSS REFERENCE TO RELATED APPLICATIONS

This application is a continuation-in-part of patent application Ser. No. 385,243, filed Jul. 25, 1989, now Pat. No. 5,059,084, which is a continuation of patent application Ser. No. 241,770, filed Sep. 7, 1988, now Pat. No. 4,863,339, which is a continuation of patent application Ser. No. 863,093, filed May 14, 1986, now abandoned, which is a continuation-in-part of U.S. Pat. No. 4,671,733, issued Jun. 9, 1987, which is a continuation-in-part U.S. Pat. No. 4,516,906 issued on May 14, 1985.

TECHNICAL FIELD OF THE INVENTION

The present invention pertains in general to bulk loading of cargo containers and, more particularly, to an installation system utilizing a waterproof liner installed with a vacuum system.

BACKGROUND OF THE INVENTION

The basic concept of providing a semi-truck trailer with a liner and ancillary support equipment has been generally proposed in the past for various reasons. For example, in U.S. Pat. No. 2,712,797 a bag like flexible container is disclosed mounted in a dump truck trailer wherein supporting means for collapsing the flexible container is provided such that the trailer can be used for bulk haulage of pourable material as well as for general hauling. U.S. Pat. No. 3,756,469 discloses a flexible liner used in a hopper vehicle, again where the flexible liner is supported within the trailer such that it is collapsible, allowing the trailer to be converted to general hauling. Other specialized applications for open topped trailer liners have been proposed such as in U.S. Pat. No. 4,186,845 wherein a foamed base sheet with polymeric top sheet is proposed for creating a tub within a trailer and U.S. Pat. Nos. 3,980,196 and 4,124,136 disclose flexible liners with framework and bulk head that essentially convert the trailer into a container for bulk cargo transport. Similarly, U.S. Pat. No. 3,951,287 discloses a flexible liner that is supported within a conventional semi-trailer by stretchable connectors along the trailer sidewalls that essentially convert the trailer to bulk material shipping.

In contrast to the prior art concept of using a flexible liner for bulk handling, theoretically there are other applications for use of a liner within a trailer provided such liner would be relatively inexpensive, be readily and conveniently installed without essentially any down time or significant additional labor costs and provided that no other significant health hazard or risk is associated with its use. For example, it is known and generally tolerated in the trailer industry that certain types of common and ordinary goods statistically incur significant water damage associated with conventional transportation procedures independent of continuing efforts to prevent such shipping damage. In particular, moisture damage to cigarette and other tobacco products during transportation is known to be a troublesome problem in the industry, as is moisture and water damage to various paper products and paper related articles directly attributable to leaks in the semi-trailer. Although damages associated with such occurrences can be considered a significant statistical risk and cost from an insurance industry viewpoint, the actual effectiveness of correcting the problem by conventional methods (e.g., better packaging, sealing leaks in the trailer, etc.) is cost prohibitive relative to insuring the risk.

Another problem that exists is that of the bulk loading cargo, such as grain, chemicals, etc. In bulk loading of cargo a bulkhead is provided that can be mounted on the end of the back of the truck at the opening thereof when loading, and then be removed when unloading. Typically, some type of liner is provided on the interior walls of the container and then the bulkhead disposed at the rear opening of the container. This bulkhead typically has an opening at the other end thereof to allow bulk materials to be loaded therein. At present, some type of rigid panel is mounted at the rear of the container. This panel is either secured with separate mounting brackets to the container or it is made a part of a liner that lines the walls of the container. One such system is illustrated in U.S. Pat. No. 3,696,952, issued October 10, 1972. However, these systems have proven to be difficult to work with, resulting in very lengthy installations and considerable expense.

SUMMARY OF THE INVENTION

The present invention disclosed and claimed herein comprises a bulkhead for loading bulk cargo in a rear opening of a container having a liner disposed therein. The bulkhead includes a flexible sheet sized to cover the rear opening in the container, with a portion of the rear opening at the upper end thereof accessible for loading of cargo. A support mechanism is provided for supporting the flexible sheet against the weight of the cargo. The support mechanism allows the flexible sheet to collapse when not covering the rear opening of the container. A securing device is provided for securing the support mechanism to the rear opening of the container.

In another aspect of the present invention, the support mechanism includes a plurality of longitudinal members that are disposed along the surface of the flexible sheet in a horizontal position and attached to the surface thereof at predetermined spaced apart distances. The ends of the longitudinal members extend outward and are operable to reciprocate within channels on the sides of the container. The longitudinal members are canted at an angle and inserted into the channels and, when in a horizontal position, prevented from moving outward therefrom. Webbing straps are provided on either end of the first and second ends of the longitudinal members and attached thereto at the spaced apart distances. The lower ends of the webbing straps are connected to the lower surface of the container and the upper ends thereof are pulled upward and secured to the upper portion of the container when the longitudinal members are at the spaced apart distance in order to provide a taut surface therefore.

In a yet further aspect of the present invention, an opening is provided in the lower portion of the flexible sheet that is releasably closed. When opened, the portion of the liner on the interior of the container is accessible to allow cutting thereof for the cargo to exit therefrom.

BRIEF DESCRIPTION OF THE DRAWINGS

For a more complete understanding of the present invention and the advantages thereof, reference is now made in the following description taken in conjunction with the accompanying Drawings in which:

FIG. 10 illustrates a rear view of the bulkhead utilized with the vacuum system of the present invention;

FIG. 11 illustrates a perspective view of the bulkhead;

FIG. 13 illustrates a cross-sectional view of the bulkhead with a liner installed.

DETAILED DESCRIPTION OF THE INVENTION

Figure 1:
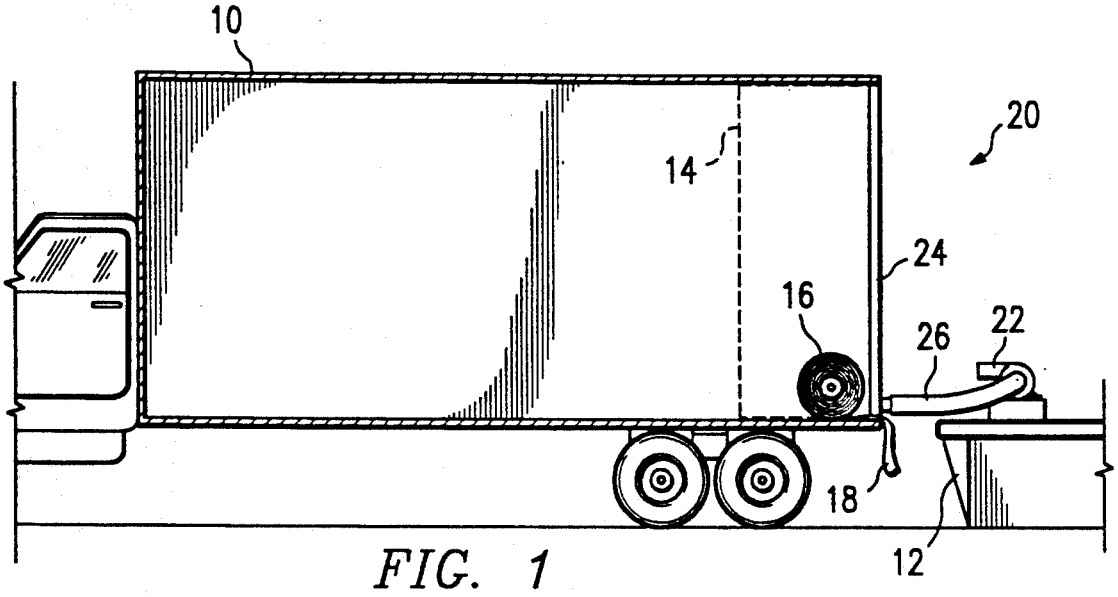
FIGS. 1 through 3 illustrate partial cross-sectional views illustrating the sequential steps associated with the method of the present invention for placing a stand-alone, moisture proof liner in a semi-trailer.

The method of installing a waterproof liner according to the present invention can perhaps be best explained and understood by reference to the drawings. FIG. 1 illustrates a conventional semi-tractor trailer 10 backed up to a loading dock 12 with rear doors 14 of the trailer 10 opened for installation of the liner 16. As illustrated, liner 16 is initially in a deflated state and, in this embodiment, rolled up in a tight coil. The liner 16 is essentially a large plastic bag or inflatable bladder wherein the opening 18 of the liner is positioned at the doorway 20 of the trailer. The liner is then unrolled or unfolded and stretched out such that it extends along the floor of the trailer and the open end of the bag extending out the doorway. An air blower 22 is positioned on the dock 12 and directed toward the back of the trailer 10 such as to be turned on later when inflating the liner 16.

Figure 7:
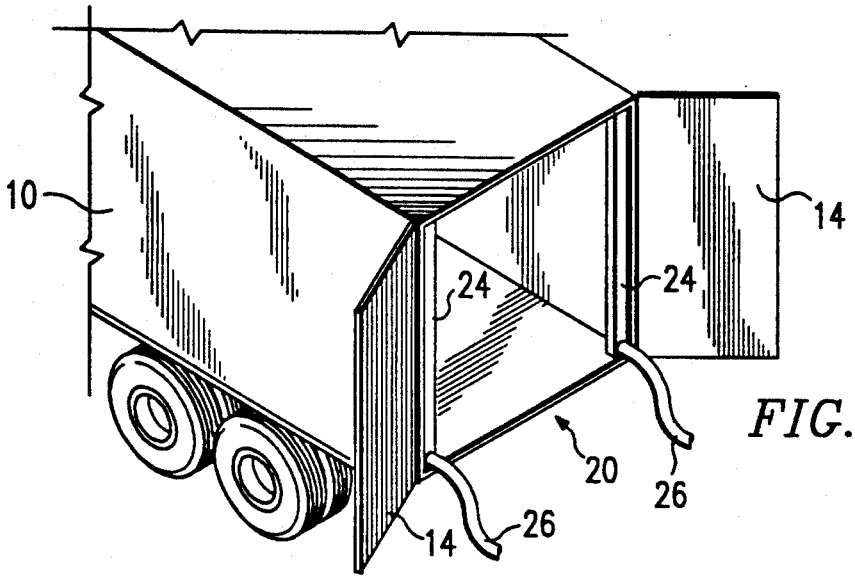
FIG. 7 illustrates vacuum assist equipment installed in a semi-trailer before inflation of the liner.

Also, a pair of vertical vacuum tubes 24 (see FIG. 7) are inserted on the interior of the sidewalls at the rear of the semi-trailer near the hinged portion of the door 14. Each of the vacuum tubes 24 are connected via flexible hoses 26 to the suction side of blower 22. It should be appreciated that other physical configurations, equipment and methods of applying suction to the interior of the trailer or cargo container between the plastic liner and the container sidewalls can be employed in the present invention. As such, various suction tubes or other air channels can be readily incorporated into the present invention, including by way of example, but not limited thereto, horizontal tubes extending from the door of the trailer back into the rear of the container, air channels built into the sidewalls of the cargo container or trailer, horizontal suction tubes along the top and/or bottom of the doorway, and the like. It should be further appreciated that the vacuum tubes 24 of the drawing as well as any equivalent structure according to the present invention should be perforated (not shown) along the device such as to withdraw air potentially trapped between the expanding plastic liner and the sidewalls confining the liner.

Figure 2:
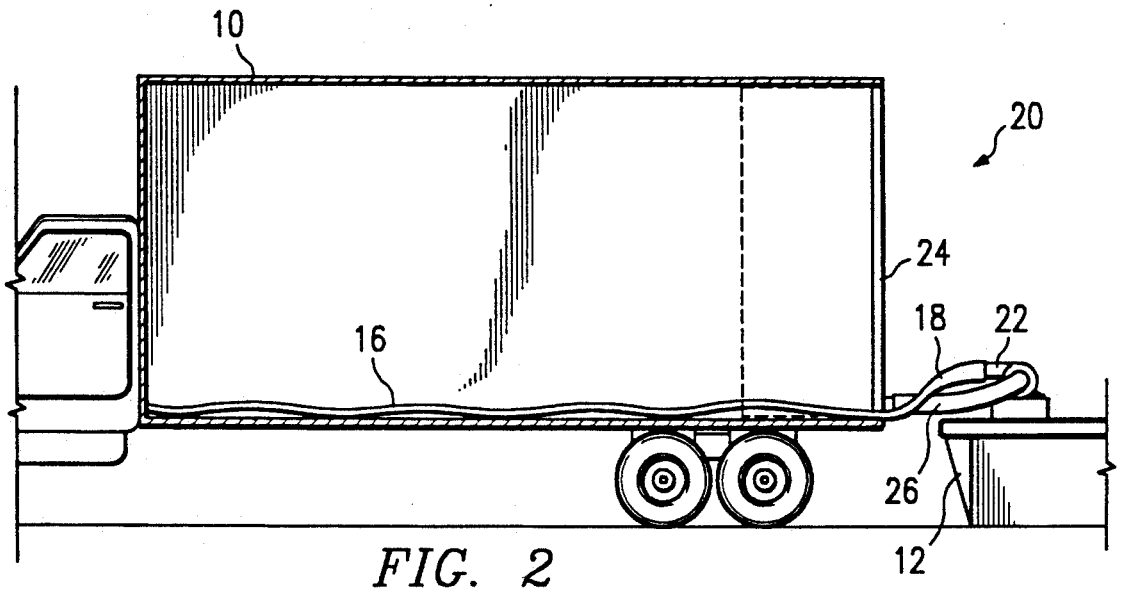

FIG. 2 illustrates liner 16 fully extended in the trailer 10 with the liner opening 18 being mounted directly to the air outlet side of the blower 22. Various alternative methods of attaching the liner 16 to the air supply can be employed. Thus, the opening 18 can be connected directly to the blower outlet as illustrated or can be attached to various types of nozzles, connectors or the like which in turn are fed air from a blower, air manifold or even compressed gas cylinder or other equivalent source. Similarly, it is envisioned that the vacuum tubes 24 can be physically attached through various types of nozzles, connectors, or the like, to any appropriate vacuum source, including the inlet side of the blower, or other equivalent low pressure device or equipment.

Figure 3:
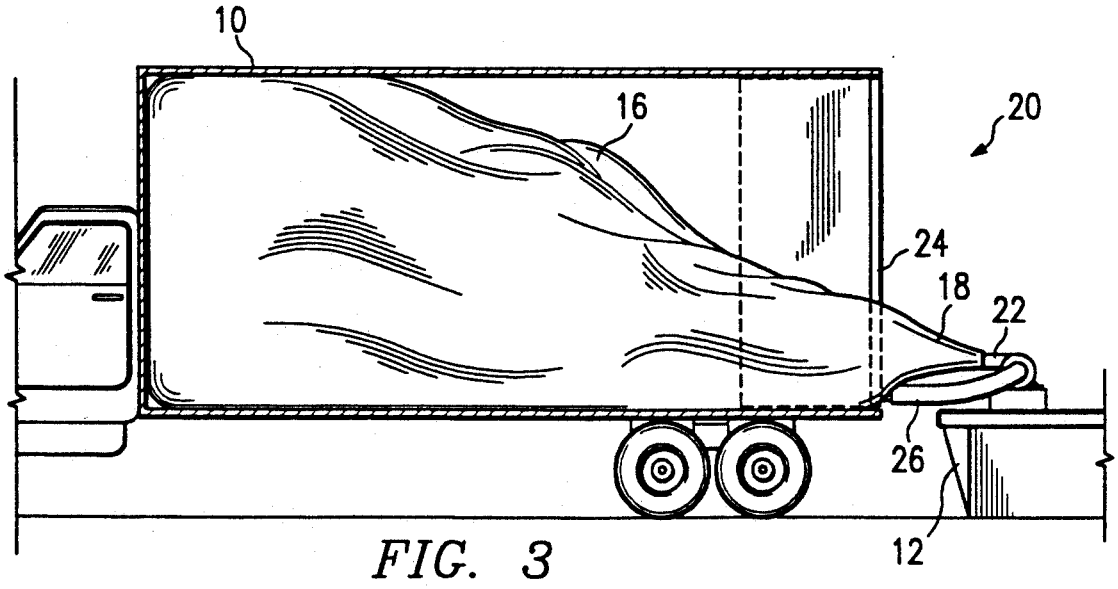

Having secured the opening 18 of the liner 16 to the blower 22, the blower 22 is then turned on and gentle stream of air is directed into the liner 16. The air is selectively directed to the front of the trailer 10 (see FIG. 3) such that the liner 16 inflates to the ceiling of the trailer in the front portion of the trailer first. The blower 22 continues to gradually fill the liner 16 from the front of the trailer to the rear of the trailer. To assist in this critical inflation step, tension can be selectively applied to the upper surface of the liner 16 by manually pulling downward and outward on the upper edge of the liner opening 18, if necessary. Experience indicates that if the liner 16 is not inflated from the front to the rear, thus systematically displacing any trapped air behind the bag, the entire liner 16 will tend to exit the trailer during the inflation step. Experience further indicates that when applying sufficient suction to the region between the liner 16 and the confining sidewalls as the liner 16 inflates, the tendency of the liner 16 inside the trailer to be forced out of the trailer is significantly reduced.

In view of the above step, it is also critical that the dimensions of the liner 16 be selected such that it will fit the entire interior of the trailer. Preferably, the liner 16 is a cylindrically shaped bladder having a diameter slightly greater than the larger of the width or height of the inside of the trailer.

Figure 4:
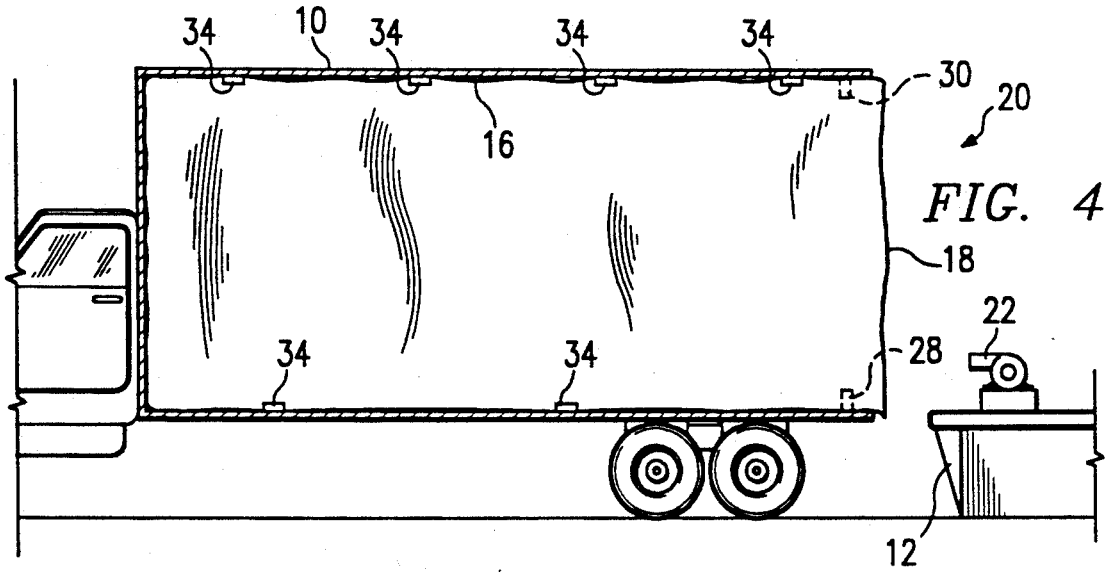
FIGS. 4 and 5 illustrate the free standing waterproof liner fully installed and ready for loading of the trailer.
Figure 5:
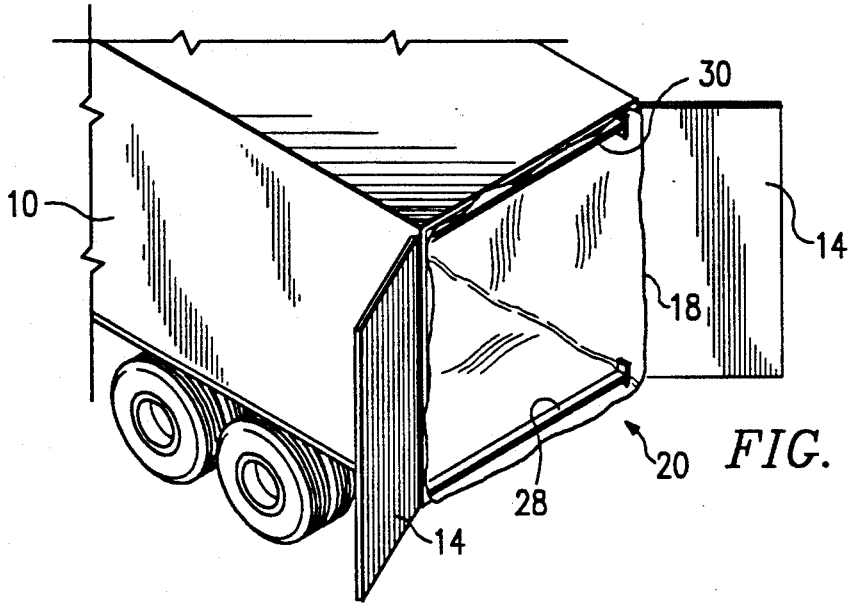
Figure 6:
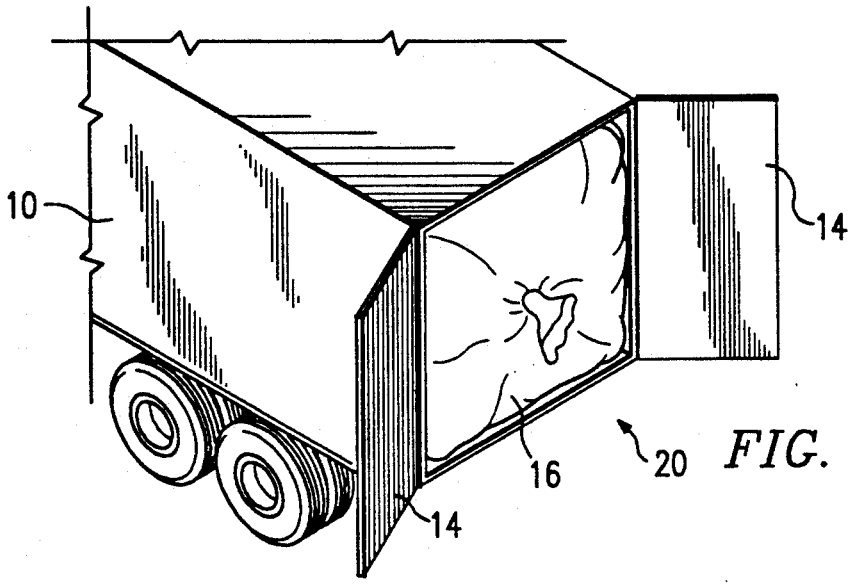
FIG. 6 illustrates the moisture proof liner sealed around the cargo of a loaded trailer.

As illustrated in FIGS. 4 and 5, once the liner 16 is fully inflated, the opening 18 can be removed from the air source and the liner 16 can be attached to the perimeter of the trailer doorway 20. In the specific embodiments of the drawing, the tension bars 28 and 30 are used to temporarily seal the bag opening 18 at the trailer doorway 20. Continued application of suction is an acceptable alternative to the use of tension bars. Also, any temporary sealing or fastening means or method well known in the art can be employed to temporarily attach the liner 16 to the doorway. The trailer is now ready to be loaded in a conventional manner. During loading, the blower may also remain in operation. However, the liner 16 once correctly inflated and sealed at the trailer doorway tends to remain in an inflated state for a considerable period of time, even without air or suction assist. After loading the cargo into the trailer, the blower is turned off and the excess liner material is wrapped around the end of the cargo and sealed such as to insure a moisture proof enclosure surrounding the entire cargo (see FIG. 6).

As previously stated, the liner 16 or inflatable protective bladder of the present invention is preferably a thin polymeric film bag of sufficient size to make contact upon inflation with the entire interior of the enclosure. It is contemplated that the liner 16 can be made of any of the conventional film grade polymeric compositions, including by way of example, but not limited thereto, polyolefins such as high density polyethylene, low density polyethylene, polypropylene and blends thereof, film grade vinyl polymers as well as natural polymeric materials such as cellulose type film. The class of polymeric film compositions that has been found to be particularly useful in the manufacturing of the plastic liner are the film grade blends of high density polyethylene with low density polyethylene. The liner 16 is contemplated as being capable of being fabricated from a series of polymeric strips or sheets which are adhesively bonded or heat sealed along longitudinal seams to each other to form the liner 16. The liner 16 can also be extruded in a single sheet or cylindrical tube provided an extrusion dye of sufficient size is available. If longitudinal pieces are to be sealed together to make the bag, the use of a thicker film for the floor, along with color pigmentation and non-slip additives to identify the floor versus the sidewalls can be incorporated into the construction of the liner 16. Experience indicates that when polyolefins such as polyethylene blends are used, the liner 16 can be made out of a relatively thin film. A 2-mil polyethylene film has been successfully tested under conventional interstate commerce transportation conditions and has proved to be quite adequate for purposes of this invention. In fact, such liners have exhibited the ability to be reused if desired, but the inexpensive nature of the thin film would not necessitate reuse and is highly suggestive of disposing of the liner after one shipment.

The actual time, effort and equipment employed to install the liner is surprising nominal. Under conventional semi-trailer dock loading procedures and environment, the time required to actually inflate the liner 16 has been measured to be as short as three minutes. The procedure employed during this observation was essentially as illustrated in the drawing and involved air movement equivalent to that produced by a conventional air blower or air fan.

The use of polyolefin film liners of the present invention is particularly useful to protect tobacco products, paper products, foods and drugs, as well as other highly moisture sensitive cargo. The liners are also useful in shipping cargo that require ultra clean or an uncontaminated environment and could also be readily adapted to be used to maintain an inert vapor phase or gaseous environment. It is envisioned that the method of installing the film liner can be advantageously employed in semi-trailers, cargo containers or generally any equivalent transportation or storage facility wherein an inexpensive, throw-away plastic liner would be appropriate.

Figure 8:
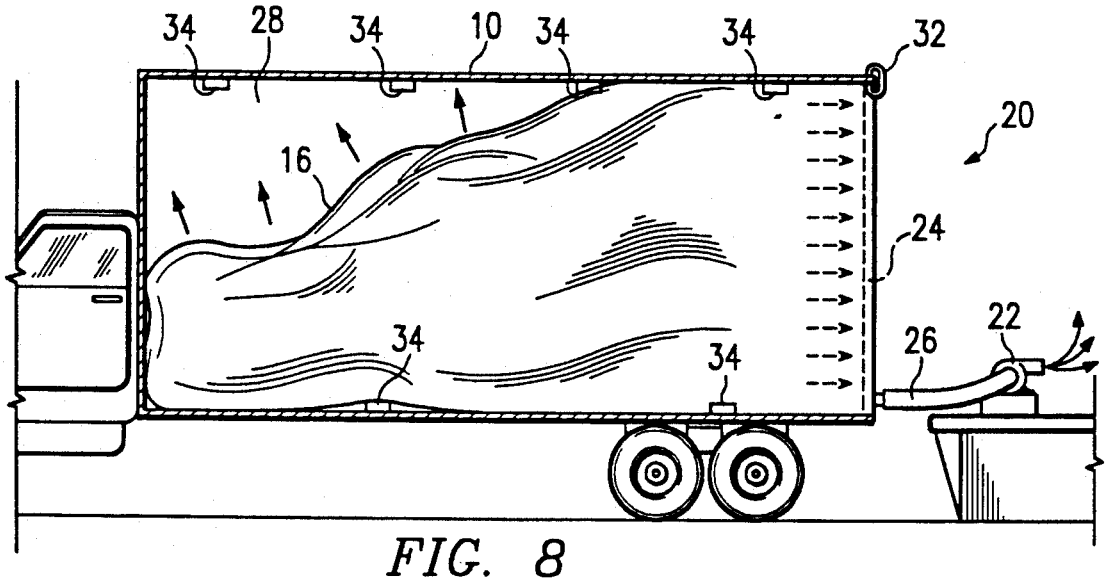
FIG. 8 illustrates the method of the present invention utilizing only vacuum assist inflation of the liner.

Referring now to FIG. 8, there is illustrated an alternate method for practicing the invention. The blower 22 is operated such that it only draws a vacuum through hose 26 from the vacuum tubes 24. These vacuum tubes 24 in the preferred embodiment draw a vacuum along the sides of the interior of the trailer to evacuate a space 28 between the bag 16 and the trailer body 10. The trailer body 10 is essentially a semi-sealed enclosure such that a negative pressure is created in space 28 when a vacuum is drawn through hose 26 by blower 22. The vacuum or negative pressure in space 28 causes the bag 16 and the surfaces thereof to raise upward against the sides of the trailer body 10 due to atmospheric pressure existing on the interior of the bag 16. In order to provide a sufficient seal for space 28, the edges of the bag 16 proximate to the periphery of the trailer are attached by clamps 32 to the edge of the trailer. The clamps are any type of C-type clamp which can grip the edge of the peripheral rim of the trailer.

In operation, the bag is first laid out in the conventional manner, as described above, in the trailer and then the peripheral edge at the opening of the bag is attached to the peripheral edge of the trailer opening. These edges are then clamped to provide a seal and then the blower 22 is turned on to produce a negative pressure in space 28. This causes the sides of the bag 16 to rise upward against the inside surfaces of the tailer body 10. However, it is not necessary for the bag to actually touch all sides of the trailer. It is therefore unnecessary to have the air blowing in the interior of the bag to create a positive pressure on the inner surfaces and therefore, the operation is significantly simplified.

Referring further to FIGS. 4 and 8, retaining members 34 are disposed along the upper edge in the corner of the container 10 on the inside thereof and spaced apart approximately four to eight feet. If necessary, a retaining members 34 is disposed on the bottom corner on either side thereof. The purpose of the retaining member 34 is to allow the motor 22 to be removed after inflation thereof.

In operation, the retaining members 34 are either integrally formed with the container 10 or they are placed into the container 10 prior to insertion of the liner 16. The individual retaining member 34, as will be described hereinbelow, is comprised of two portions, a first portion being adhered to or integrally formed with the interior of the container 10 and a second portion for securing the liner 16 to the first portion. Therefore, the first portion is adhered to the interior of the container 10 and the liner installed therein. The second portion of the retaining member 34 is then installed without puncturing the liner 16, thus securing the liner 16 to the interior walls of the container 10. This therefore allows the container 10 and the moved liner 16 to be installed to a different location for loading. Without the use of the retaining member 34, the liner 16 would collapse when the motor 22 is removed.

Figure 9:
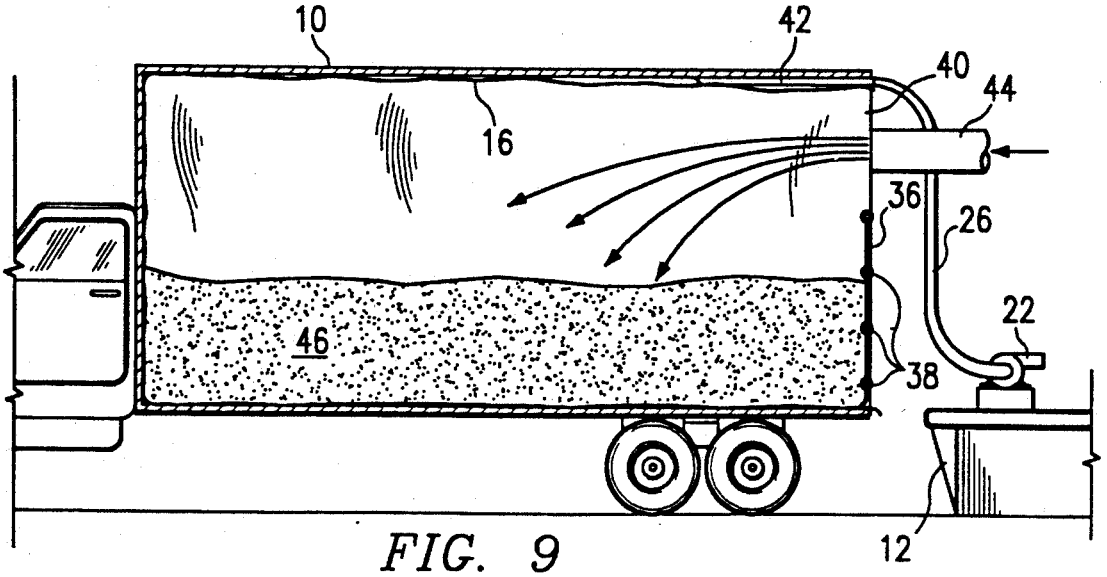
FIG. 9 illustrates a cross-sectional view of the bulk loading system of the present invention.

Referring now to FIG. 9, there is illustrated a cross-sectional view of the system for unloading bulk materials into the container 10. The bulkhead loading system utilizes the vacuum-only installation system to install the liner 16 on the interior walls thereof. However, prior to installing the liner, a flexible bulkhead 36 is mounted in the rear of the container 10 and supported in channels (not shown) by poles 38. The liner 16 is disposed up over the flexible bulkhead 36 with the flexible bulkhead 36 extending only a portion of the way up from the bottom of the container 10, resulting in an opening 40 at the upper end of the rear of the trailer for loading of cargo. The return hose 26 to the vacuum source 22 is connected to a vacuum manifold 42 that is disposed on the upper end of the container 10 at the rear opening thereof. The manifold 42 extends along the upper surface of the container 10 and inward thereto and has a plurality of orifices disposed therein, similar to the manifold 42. The manifold 42 will therefore create a vacuum in the space between the outer surfaces of the liner 16 and the interior surfaces of the container 10. Once the liner 16 has been inflated and is urged against the walls of the container 10 on the interior thereof, a loading conduit 44 is disposed in the opening 40 and bulk cargo 46 is loaded therein. The flexible bulkhead 36 prevents the bulk cargo 46 from exiting the container 10.

Referring now to FIG. 10, there is illustrated a detail of the flexible bulkhead 36 mounted in the rear of the container 10. Each of the poles 38 are attached to the flexible bulkhead 36 at evenly spaced points. They are typically between twelve to eighteen inches apart with one of the poles 38 disposed at the upper end of the flexible bulkhead 36 and the lowermost pole 38 being disposed approximately twelve to eighteen inches above the floor of the container 10. Each of the poles 38 are connected to the flexible bulkhead 36 at a defined position. Typically, they are sewn in through channels. The poles 38 have a webbing strap 50 disposed on one side thereof and a webbing strap 52 disposed on the other side thereof. Each of the webbing straps 50 and 52 is operable to be connected to the respective ends of the poles 38 at spaced apart points. Each of the attachment points corresponds to the distance at which the poles 38 are disposed apart from each other when the flexible bulkhead 36 is mounted in the trailer.

The ends of the poles 38 are disposed on one side thereof in a channel 54 and on the other side thereof in a channel 56. The channels 54 and 56 are part of the conventional container 10. The poles 38 are dimensioned such that they extend from channel 54 to channel 56 when in the horizontal position, such that they cannot be pulled out from the container 10 when in a horizontal position. In order to insert the poles 38 into the channels 52 and 56, they are canted at an angle with respect to the bottom of the container 10, inserted into the channels 52 and 56 and then disposed in the horizontal position.

After the poles 38 have been disposed in channels 54 and 56, the lower end of the webbing strap 52 is connected to a hook 58 at the bottom corner of the container 10 and, similarly, the bottom end of the webbing strap 50 is connected to a hook 60 at the bottom and opposite corner of the container 10. The upper end of the strap 52 is connected through a hook 62 and the upper end of the webbing strap 50 is connected through a hook 64. By putting tension on each of the webbing straps 50 and 52, the poles 38 are pulled apart, and the flexible liner 36 placed in a taut position. The webbing straps 50 and 52 can then be secured about the hooks 64 and 62, respectively.

The flexible bulkhead 36 has a flap 66 and a flap 68 disposed on respective opposite sides of the flexible bulkhead 36 and extending inward to the container 10 and adjacent the sides thereof. The operation of flaps 66 and 68 will be described hereinbelow.

Referring now to FIG. 11, there is illustrated a perspective view of the flexible bulkhead 36 from the interior of the container 10. The flaps 66 and 68 can be seen as extending from the sides of the flexible bulkhead 36 on the exterior thereof. In addition, there is a bottom flap 70 that extends from the bottom edge of the flexible bulkhead 36 inward along the floor of the container 10. The flap 66 has a downward extending portion 72 and the flap 68 has a downward extending portion 74 that is folded over and extends inward over the surface of the bottom flap 70 and is sewn thereto. Therefore, the flaps 66, 68 and 70 provide a continuous surface around the sides and lower peripheral surfaces of the exterior opening in the container 10. The flexible bulkhead 36 is made from a single piece of flexible polypropeline type material having a woven structure for support. The material is cut into shape to provide both the exterior surface and the flaps 66–70 with the folded over ends 74 and 72. The flaps 68–70, as configured in FIG. 11, provide a very important sealing function during the inflation process of the liner 16, as will be described hereinbelow.

Figure 12:
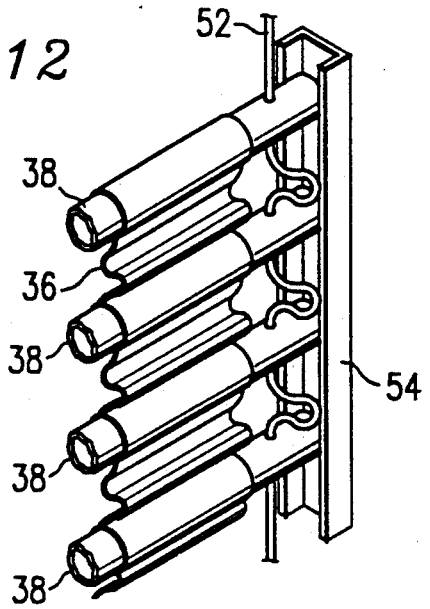
FIG. 12 illustrates a detail of one side of the flexible bulkhead in a relaxed position.

Referring now to FIG. 12, there is illustrated a detail of one end of the pole 38 disposed in the channel 52 and being in a relaxed position. It can be seen that when the webbing strap 52 is not tensioned, the poles 38 collapse onto one another due to the flexibility of the bulkhead 36. When the webbing strap 62 is pulled taut, the poles 38 are pulled upward, pulling the material of the flexible bulkhead 36 upward also to a taut position. In order to provide strength, the poles 38 are fabricated from hollow metal rods, as typically found in electrical conduit.

Referring now to FIG. 13, there is illustrated a cross-sectional detail of the flexible bulkhead 36 in the mounted position with the webbing straps 50 and 52 pulled taut. The liner 16 is disposed over the upper edge of the flexible bulkhead 36 and a clip 76 utilized to hold the outer peripheral edge of the liner 16 thereto. However, it is possible for the air to come in under the flexible bulkhead 36 and under the flap 70. However, the flaps 66–70 provide the function of preventing substantial deformation of the bottom portion of the flexible bulkhead 36 and thereby allowing air to enter at the lower end thereof. Of course, there is never a perfect seal formed in the present system, but the seal must be sufficient to allow a negative pressure to exist between the outer surfaces of the liner 16 and the inner walls of the container 10. The flaps 66–70 maintain a certain conformation for the lower end of the flexible bulkhead 36 to prevent any significant amount of air from coming in. Without this conformation, the lower end of the bulkhead 36 will push inward during vacuum installation of the liner 16.

Figure 14:
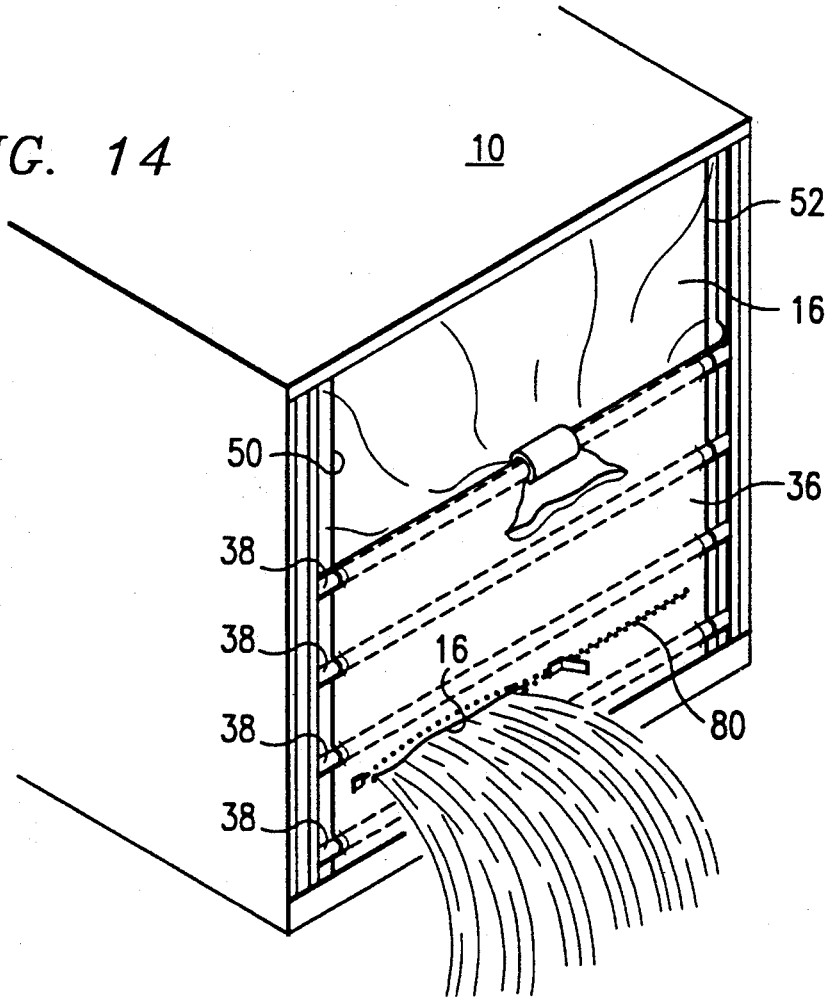
FIG. 14 illustrates a detail of the releasable opening at the bottom of the bulkhead for unloading the material in the container.

Referring now to FIG. 14, there is illustrated a rear view of the loaded container 10 with the flexible bulkhead 36 in position. At the lower end of the flexible bulkhead 36, a zipper 80 or similar device is provided that allows access to the outer surface of the liner 16. The zipper 80 is opened and then a sharp instrument of some sort is utilized to pierce the liner 16 to allow the bulk material to flow therefrom when the container 10 is tilted upward. In this manner, the flexible bulkhead 36 is reusable. Without the zipper 80, it would be necessary to destroy the lower end of the liner 36 in order to remove the material loaded therein.

In summary, there has been provided a bulk loading system. The system includes a flexible liner that is disposed on the end of the container at the rear opening therein. A flexible bulkhead comprises a flexible sheet having poles disposed therethrough in a horizontal and spaced apart configuration. The poles are inserted in channels on the side of the trailer and are operable to reciprocate upward therein. A spacing device is utilized to space and secure each of the poles such that the flexible bulkhead attached thereto is maintained in a taut configuration. A liner is then disposed inside the container and the walls thereof urged outward against the sides of the container through a vacuum disposed therebetween.

Although the preferred embodiment has been described in detail, it should be understood that the various changes, substitutions and alterations can be made therein without departing from the spirit and scope of the invention as defined by the appended claims.

What is claimed is:

1. A bulkhead for loading bulk cargo in a rear opening of a container disposed on its side with the rear opening at one end thereof and having an upper end and a lower end, the container having a floor, a ceiling, side walls and a flexible liner disposed therein substantially adjacent interior surfaces thereof by a vacuum system that creates a negative pressure between an exterior of the liner and the interior surfaces of the container, the bulkhead comprising:

a flexible sheet having peripheral edges and sized to cover the rear opening in the container with a portion of the rear opening at the upper end thereof accessible for leading of the cargo;

sealing means associated with said flexible sheet to minimize air passage between outer peripheral edges of said flexible sheet that are adjacent to peripheral edges of the rear opening of the container to provide a seal to allow a vacuum to be formed between exterior surfaces of the flexible liner and the interior surfaces of the container during installation of the flexible liner;

a support mechanism having a collapsed configuration and an uncollapsed configuration for providing support for said flexible sheet to exert a resisting force against the bulk cargo at the rear opening when said support mechanism is in the uncollapsed configuration;

said support mechanism operable in the collapsed configuration to allow said flexible sheet to collapse for storage thereof; and a securing device for securing said support mechanism to the rear opening of the container in the uncollapsed configuration to cover the rear opening of the container.

2. The bulkhead of claim 1 wherein said flexible sheet has a substantially flat surface when said support mechanism is in the uncollapsed configuration and said support mechanism comprises a plurality of longitudinal members for being attached to the surface of said flexible sheet and extending horizontal tot he floor of the container when said flexible sheet is disposed in the rear opening of the container and said support mechanism is in the uncollapsed configuration, said longitudinal members being spaced apart a predetermined distance along the surface of said flexible sheet.

3. The bulkhead of claim 2 wherein the rear opening is rectangular in shape having a lower edge, an upper edge and first and second side edges, said support mechanism comprising:

a first channel disposed on one side of said container and extending upward along the first side edge of the rear opening of the container;

a second channel for being disposed in the rear opening of said container and for extending up the second side edge of the rear opening of the container;

said longitudinal members each having first and second ends said first end being disposed in said first channel and said second end being disposed in said second channel;

the first and second ends of said longitudinal members operable to reciprocate within said respective first and second channels; and a tightening device for urging said longitudinal members to a spaced apart configuration to force said flexible sheet to a taut position.

4. The bulkhead of claim 3 wherein said tightening device is operable to urge the first and second ends of said longitudinal members apart from each other in said first and second channels, respectively.

5. The bulkhead of claim 3 wherein said tightening device comprises first and second strapping devices, respectively, each disposed such that they are attached to respective first and second ends of said longitudinal members, each of said first and second strapping devices having first and second ends, the first end thereof operable to be secured to the floor of the container and the second end thereof operable to be secured to the ceiling of said container; and said first and second strapping devices when pulled upward operable to pull associated ones of said first and second ends of said longitudinal members up to a spaced apart distance and then be secured at the upper end thereof to maintain the respective first and second ends of said longitudinal members at the spaced apart configuration.

6. The bulkhead of claim 1 wherein said sealing means comprises at least on flap extending from at least one of the peripheral edges of said flexible sheet that is adjacent to the peripheral edges of the rear opening in the container and extending back into the container.

7. The bulkhead of claim 1 wherein said sealing means comprises:

a first flap for being attached along the lower peripheral edge of said flexible sheet adjacent tot eh lower peripheral edge of the rear opening in the container and extending rearward therein along the floor of the container;

a second flap for being disposed along the peripheral edge of said flexible sheet adjacent to one side of the rear opening in the container and extending back into the container along one of the side walls thereof;

a third flap for being attached along the peripheral edge of said flexible liner adjacent to the side of the rear opening in the container opposite to the side of the rear opening in the container adjacent to said second flap, said their flap extending back in to the container along the other of the side walls of the container;

said second flap having a lower edge connected to a lateral side of said first flap and substantially perpendicular thereto and said third flap having a lower edge connected to an opposite and lateral edge of said first flap and secured thereto at a substantially perpendicular angle thereto; and said first, second and third flaps providing support for the lower portion of said flexible sheet disposed in the lower end of the rear opening in the container.

8. The bulkhead of claim 1 and further comprising a releasable opening disposed in a lowermost portion of said flexible sheet for allowing access to the flexible liner on the opposite side thereof, said releasable opening allowing the cargo to exit therefrom when opened and the liner adjacent thereto is pierced.

9. The bulkhead of claim 8 wherein said releasable opening comprises a zipper disposed along the portion of said flexible sheet disposed in the lower end of the rear opening in the container.

* * * * *